US006298837B1

(12) United States Patent
Ketterer et al.

(10) Patent No.: US 6,298,837 B1
(45) Date of Patent: Oct. 9, 2001

(54) METHOD AND DEVICE FOR REGULATING POWER IN IGNITION SYSTEMS WITH A PRIMARY-SIDE SHORT-CIRCUITING SWITCH

(75) Inventors: Markus Ketterer; Klaus-Juergen Wald; Achim Guenther, all of Stuttgart; Juergen Foerster, Ingersheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,264

(22) PCT Filed: Oct. 26, 1999

(86) PCT No.: PCT/DE99/03413

§ 371 Date: Jun. 23, 2000

§ 102(e) Date: Jun. 23, 2000

(87) PCT Pub. No.: WO00/25021

PCT Pub. Date: May 4, 2000

(30) Foreign Application Priority Data

Oct. 26, 1998 (DE) ..... 198 49 258

(51) Int. Cl.[7] ..... F02P 3/045
(52) U.S. Cl. ..... 123/644; 123/609; 123/650
(58) Field of Search ..... 123/644, 650, 123/651, 652, 609

(56) References Cited

U.S. PATENT DOCUMENTS 5,220,821 6/1993 Moser et al. .
5,321,978 6/1994 Brandt et al. .
5,571,245 * 11/1996 Ooyabu et al. ..... 123/644
5,801,534 * 9/1998 Hohner et al. ..... 123/644
6,047,691 * 4/2000 Ketterer ..... 123/644

FOREIGN PATENT DOCUMENTS 196 10 862 9/1997 (DE) .
196 49 278 6/1998 (DE) .
0 559 540 9/1993 (EP) .
0 674 103 9/1995 (EP) .
0 848 161 6/1998 (EP) .

* cited by examiner

*Primary Examiner*—Erick R Solis
(74) *Attorney, Agent, or Firm*—Walter Ottesen

(57) ABSTRACT

A method and an arrangement for energy control on an ignition system for an internal combustion engine are presented having an ignition coil or an ignition transformer whose primary winding can be short circuited by means of a switch, called a short-circuit switch, the ignition coil forming the ignition voltage and having a primary winding and a secondary winding, and, an ion current can be measured with the secondary winding of the ignition coil by means of one or several spark plugs, the primary current in the short-circuit phase of the short-circuit switch is detected with a suitable means and is transmitted to the control unit, the measurement quantity is processed in the form of a function or filtering in the control unit after actuation of the short-circuit switch and an energy control via closure time or closure angle is built up with the obtained feature.

18 Claims, 2 Drawing Sheets

Embodiment of an Inductive Ignition System Having Energy Control

Embodiment of an Inductive Ignition System Having Energy Control

Signal Diagram of the Current $I_S$ in the Primary Winding

METHOD AND DEVICE FOR REGULATING POWER IN IGNITION SYSTEMS WITH A PRIMARY-SIDE SHORT-CIRCUITING SWITCH

FIELD OF THE INVENTION

The invention relates to an ignition system for internal combustion engines having a primary end short-circuit switch which short circuits the primary end of the ignition coil. So-called single spark coils (wherein each spark plug is allocated to an ignition coil) as well as double spark coils (in which two spark plugs are allocated an ignition coil) can be used. Other ignition systems are also conceivable which have a primary end short-circuit switch. In the following, only the single spark coil is considered because the method can be applied in the same manner to the double spark coils.

BACKGROUND OF THE INVENTION

The spark end is introduced in a controlled manner by the arrangement of a primary end short-circuit switch. In this way, the method is based on the ignition system having a shortened spark duration such as is known from DE 196 49 278. The method of the invention can also be applied to other ignition systems which shorten the ignition spark via a primary end short circuit with other means such as npn-transistors or thyristors.

An ion current measurement can be coupled with the ignition system as is known from DE 38 83 009 T2. The ion current measurement measures the ion current in the combustion chamber via the secondary end of the ignition coil and/or of the ignition transformer by means of the spark plug.

The operation of the switchoff of the ignition spark itself needs a certain time duration which can be disturbing under circumstances for the ion current measurement. Furthermore, the ignition coil and/or the ignition transformer and the short-circuit switch become unnecessarily warm because of the residual energy.

In view of this background, it is an object of the invention to:

- minimize disturbances on the ion current measurement caused by the switchoff current;
- to reduce the heat in the short-circuit switch and in the ignition transformer;
- to keep the electrode wear low; and,
- to ensure a reliable and rapid switchoff of the spark.

SUMMARY OF THE INVENTION

This object is solved with the features of the independent claims. Advantageous further embodiments of the invention are the subject matter of the dependent claims.

The invention must not perforce be connected to a detection of the ion current but offers many advantages in combination with a measurement of ion current.

A method which is good in series manufacture is introduced with the solution according to the invention of the above-mentioned problems. The method, inter alia, facilitates the realizability of the ion current measurement.

The solution according to the invention overcomes the above-mentioned disadvantages. A control variable is available for energy control via the closure time or the closure angle by the determination of a feature proportional to the residual energy.

According to the invention, a method for energy control on an ignition system for an internal combustion engine takes place with an ignition coil or an ignition transformer having a primary winding and a secondary winding and forming the ignition voltage. The primary winding of the ignition coil can be short circuited by means of a switch (called a short-circuit switch). An ion current can be measured with the secondary winding by means of one or several spark plugs. In the method, the primary current is detected in the short-circuit phase of the short-circuit switch with suitable means and transmitted to the control unit; the measurement quantity is processed in the form of a function or filtering in the control unit to a feature after actuation of the short-circuit switch; and, with the feature obtained, an energy control is built up over the closure time or closure angle.

The closure time or the closure angle is reduced in the event that the feature indicates a residual energy which is too great. The closure time or the closure angle is increased in the event that the feature indicates a residual energy which is too low.

In one embodiment, the maximum of the primary current directly after reaching the end of the spark is used as a feature, which is proportional to the residual energy, for controlling the energy via closure time or closure angle.

The drain source resistance of the short-circuit switch can be used as the means for measuring the primary current. The short-circuit switch can be configured as a field effect transistor.

Alternatively, the measurement of the primary current Is can take place via a resistance in the short-circuit loop.

In one embodiment, the control of the energy via closure time or closure angle can be suppressed in non-steady state operating points.

Furthermore, the control of the energy via the closure time or closure angle can take place in such a manner that the energy can be varied only in a specific time window or angle window which is delimited by a lower gate and an upper gate.

The limits of the closure time or of the closure angle can be controlled by a characteristic field. The characteristic field is dependent upon at least the load L and/or the rpm (n) and is stored, for example, in the control unit.

Furthermore, to control dynamic operations, the characteristic field can be subdivided into characteristic field regions. When leaving a characteristic field region, the actual closure time value or closure angle value is stored and, with a reentry into the characteristic field region, the values previously stored can be used as start values of the control.

BRIEF DESCRIPTION OF THE DRAWINGS

In the following, an embodiment of the invention is explained with reference to the figures.

DESCRIPTION OF THE PREFERRED EMBODIMENTS OF THE INVENTION

Figure 1:
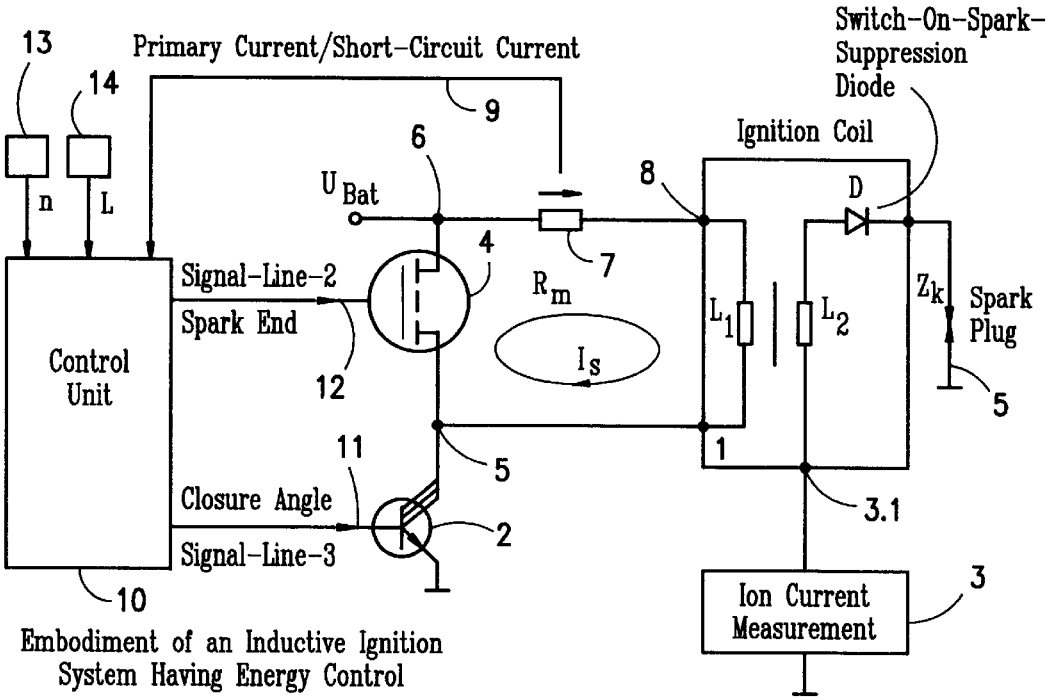
FIG. 1 shows an embodiment of an inductive ignition system having energy control.

The ignition system comprises, for example, components corresponding to those known to date from the state of the art: ignition coil 1, ignition transistor 2 and spark plug 5. It is insignificant whether a switch-on spark suppression diode D is or is not in series with the secondary winding $L_2$ of the ignition coil 1.

A means 3 for measuring ion current can be arranged in series with the ignition coil at the low voltage end of the secondary winding $L_2$. The means 3 and the ignition coil 1 define the circuit node 3.1.

The primary end of the ignition coil 1 can be short circuited via the short-circuit switch 4. The short-circuit switch 4 is advantageously configured as a field effect transistor. The field effect transistor and the ignition transistor 2 and the ignition coil 1 form the circuit node 5.

A means for measuring the short-circuit current is built into the short-circuit loop $I_s$. In the example of FIG. 1, this means is configured as measuring resistor 7. The measuring resistor 7 and the short-circuit switch 4 define the circuit node 6 and the measuring resistor 7 and the ignition coil 1 define the circuit node 8.

The feed-in of the battery voltage $U_{bat}$ for the supply of the ignition coils can be undertaken either at circuit node 6 or at circuit node 8.

As a further variation, which is easily realizable technically, there is the possibility to use the track resistor of the short-circuit switch as a measuring resistor. As a consequence, the circuit nodes 8 and 6 then fall together.

The signal of the short-circuit current is transmitted from the measuring means via the signal line 9 to the control unit 10. A feature is obtained in the control unit 10 via a function or feature formation. The closure time of the ignition transistor is varied in dependence upon this feature. The new selection of the closure time is made available to the ignition transistor 2 via the signal line 11. The short-circuit switch 4 is served by the control unit 10 via the signal line 12. Additional signals as to operating parameters of the engine are supplied to the control unit 10. Examples of such operating parameters are the engine rpm (n) and the intake air quantity L which are made available by sensors 13 and 14.

Figure 2:
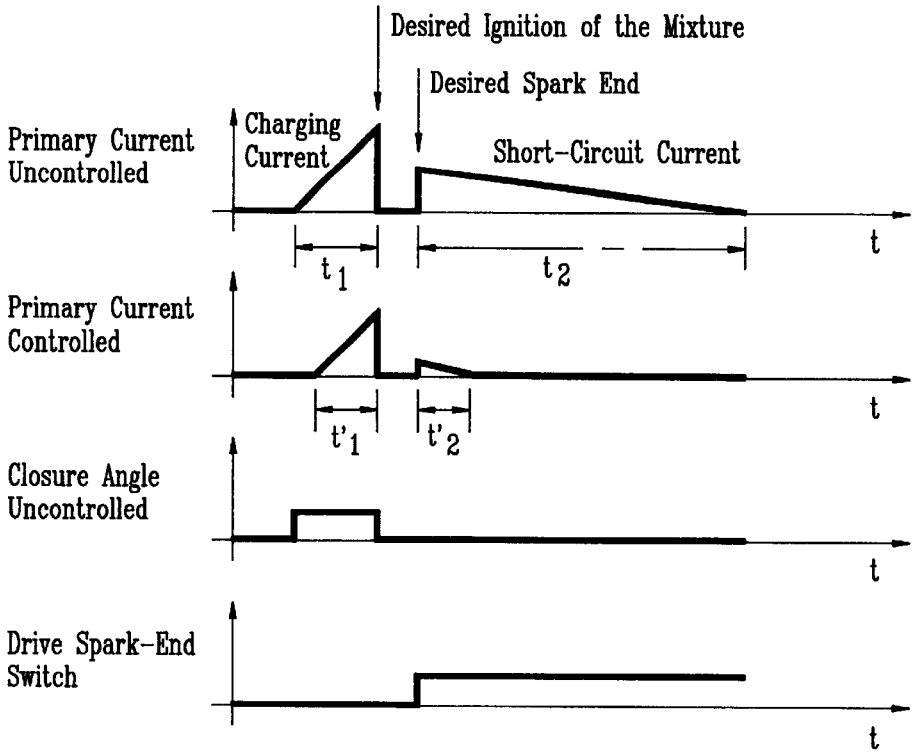
FIG. 2 includes signal images of the current $I_s$ in the primary winding of the ignition coil in time correlation with a closure angle signal and a signal for driving a spark-end switch.

FIG. 2 shows a time-dependent trace of various signals. At first, the system operates with a large closure time of the ignition transistor 2. The closure time $t_1$ is outputted by the control unit. After the time $t_1$ has elapsed, the ignition transistor 2 is switched to high ohmage and the ignition spark is generated. At the desired spark end, the short-circuit switch 4 is closed and the spark end is introduced. The primary current increases very rapidly to a maximum value and then decays exponentially in the time $t_2$. The energy, which is still present at the spark end, is dissipated in the resistors of the primary current loop. The primary current monitoring supplies the actual short-circuit current via the signal line 9. The maximum of the short-circuit current can be converted into the corresponding excess residual energy in accordance with the formula:

$$E = \frac{1}{2} L_1 \cdot \hat{I}_s^2$$

wherein:

$L_1$ is the inductance of the primary winding of the ignition coil;

$I_s$ is the short-circuit current (see FIG. 1);

$\hat{I}_s$ is the maximum of the short-circuit current.

The energy balance of the system is as follows:

$$E_{prim}=E_{sparkhead}+E_{sparkburning}+E_{rest}$$

wherein:

$E_{prim}$ is the energy introduced at the primary end;

$E_{sparkhead}$ is the energy which is lost in the spark head;

$E_{burning}$ is the energy which is necessary for the spark burning; and, $E_{rest}$ is the energy which is still available when closing the short-circuit switch and which is converted into heat energy.

The energy introduced at the primary end is consumed as follows. First, an energy component discharges in the spark head and varies depending upon the ignition voltage required. Thereafter, and depending upon the combustion voltage requirement, a varying energy component is needed during the spark combustion. During this sequence, additional losses arise in the windings and iron loops of the ignition coil. The energy in the spark head is intensely load dependent and ignition angle dependent; in contrast, the energy for the spark combustion is dependent upon the load and additionally on the turbulences in the combustion chamber. In total, the energy requirement for the spark ignition is load dependent, ignition angle dependent and rpm dependent. Additionally, the energy requirement is charged with statistic fluctuations so that only a filtered feature on the basis of the short-circuit current can be applied for the control.

The basis of the control is the detection of the residual energy shortly after reaching the required spark end and the conversion by the control unit 6 into a feature proportional to the residual energy. If sufficient residual energy is still available, then the closure angle or the closure time will be shortened in the same operating point. This cannot take place directly so that, with the detected values, for example, a lowpass filtering or a mean value formation is carried out within the control unit. Conversely, if the minimum required residual energy is no longer present, then the closure time or the closure angle is increased.

The resistor for primary current monitoring is advantageously placed in a branch of the current loop which has no connection with the circuit node 2 in order to protect the resistor against unnecessarily high voltages.

A further variation is to use the track resistance of the short-circuit switch as a measuring resistor. The short-circuit switch is configured as a field effect transistor (FET).

Figure 3:
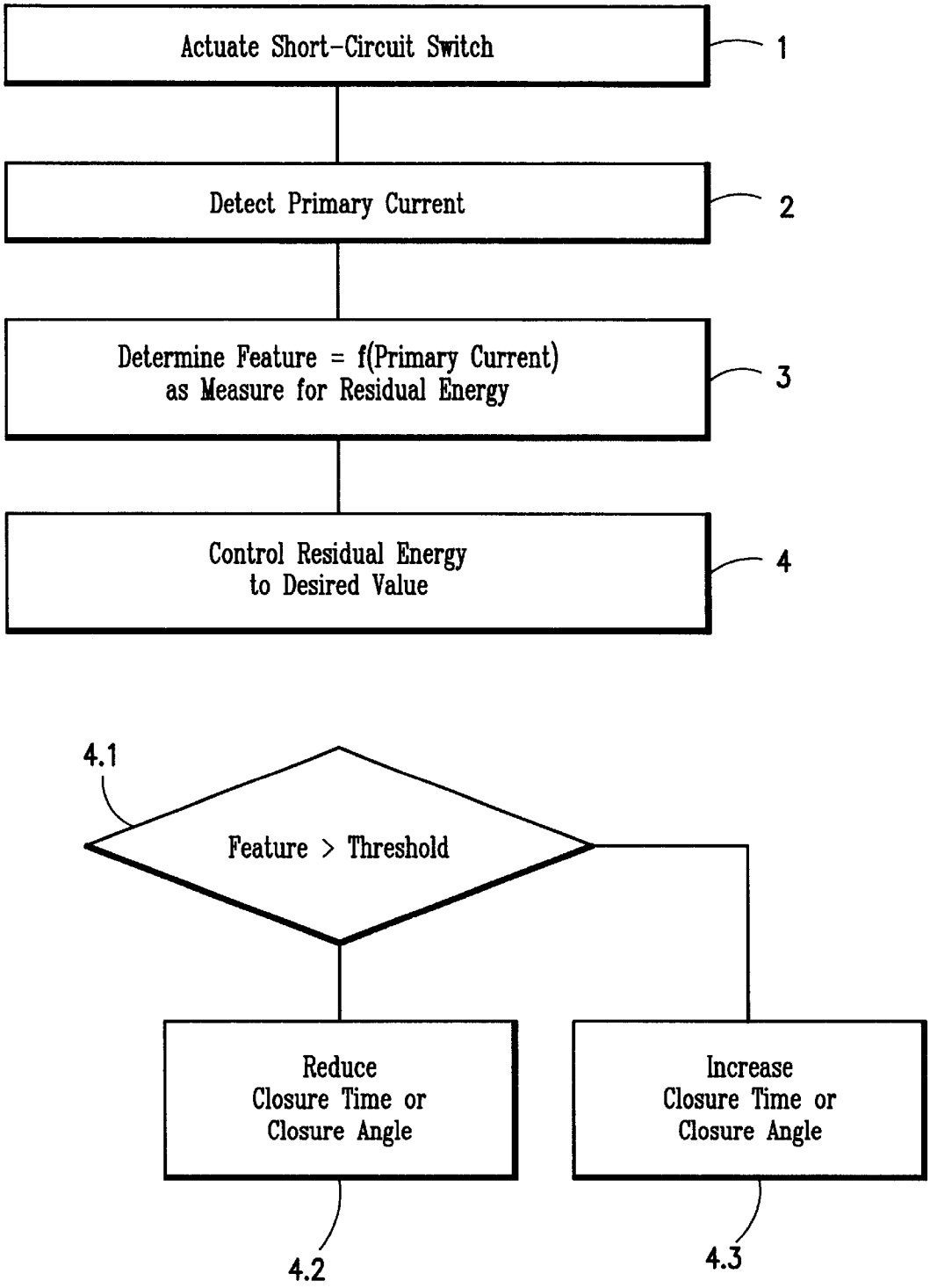
FIG. 3 shows an embodiment of the method of the invention.

FIG. 3 illustrates the control. The actuation of the short-circuit switch 4 in step 1 is followed by the detection of the primary current (short-circuit current) in step 2. Step 3 symbolizes the formation of a feature or measure for the residual energy as a function of the primary current. The feature formation includes a filtering or an averaging. In step 4, the residual energy is controlled to a predetermined desired value.

For this purpose, and as shown in steps 4.1 to 4.3, the feature, which is formed in step 3, can be compared to a threshold value.

After step 4.2, an increase of the closure time or the closure angle takes place when the feature exceeds the threshold and thereby indicates an adequately large residual energy. Otherwise, the closure time or the closure angle is increased in step 4.3.

What is claimed is:

1. A method for energy control on an ignition system for an internal combustion engine having an ignition coil or an ignition transformer whose primary winding can be short circuited by means of a switch called a short-circuit switch; the ignition coil forming the ignition voltage and having a primary winding and a secondary winding; the method comprising the steps of:

measuring an ion current with the secondary winding of the ignition coil with at least one spark plug;

detecting the primary current in the short-circuit phase of the short-circuit switch and transmitting the measuring quantity to the control unit;

processing the measuring quantity after actuation of the short-circuit switch in the form of a function or filtering in the control unit to a feature; and, building up an energy control with said feature via a closure time or a closure angle.

2. The method of claim 1, wherein the closure time or the closure angle is shortened in the event that the feature indicates too large a residual energy or that the closure time or the closure angle is lengthened in the event that the feature indicates a residual energy which is too low.

3. The method of claim 1, wherein the maximum of the primary current directly after reaching the spark end is used as a feature, which is proportional to residual energy, for energy control via said closure time or said closure angle.

4. The method of claim 1, wherein the means for measuring the primary current is the drain source resistance of the short-circuit switch configured as a field effect transistor.

5. The method of claim 1, wherein said means for measuring the primary current $I_s$ is a resistor in the short-circuit loop.

6. The method of claim 1, wherein the control of the energy via closure time or closure angle can be suppressed in non-steady state operating points.

7. The method of claim 1, wherein the control of the energy via closure time or closure angle can only be varied within a specific time window or angle window which is delimited by a lower gate and an upper gate.

8. The method of claim 7, wherein the limits of the closure time or of the closure angle are characteristic field controlled which is dependent at least upon load or rpm and, for example, is stored in the control unit.

9. The method of claim 1, wherein, for controlling the dynamic operations, the characteristic field is subdivided into characteristic field regions and, when leaving a characteristic field region, the actual closure time value or closure angle value is stored and upon reentry into the characteristic field regions, the adapted values are used as start values of the control.

10. An arrangement for the energy control on an ignition system for an internal combustion engine having an ignition coil or an ignition transformer whose primary winding can be short circuited by means of a switch, called a short-circuit switch, the arrangement comprising:

a control unit;

means for measuring an ion current with the secondary winding of the ignition transformer via one or more spark plugs;

said ignition coil forming an ignition voltage and having a primary winding and a secondary winding;

means for detecting the primary current in the short-circuit phase of the short-circuit switch and transmitting the measurement quantity to the control unit;

said control unit including means for processing said measurement quantity to a feature in the form of a function or filtering in the control unit after actuation of the short-circuit switch; and, means for building up an energy control over closure time and closure angle with the obtained feature.

11. The arrangement of claim 10, wherein the closure time or the closure angle is shortened in the event that the feature indicates a residual energy which is too great or the closure time or closure angle is lengthened in the event that the feature indicates a residual energy which is too low.

12. The arrangement of claim 10, wherein the maximum of the primary current directly after reaching the spark end is used as a feature, which is proportional to residual energy, for the energy control via closure time or closure angle.

13. The arrangement of claim 10, wherein said means for measuring the primary current is the drain source resistance of the short-circuit switch, the short-circuit switch being configured as a field effect transistor.

14. The arrangement of claim 10, wherein said means for measuring the primary current $I_s$is a resistor in the short-circuit loop.

15. The arrangement of claim 10, wherein the control of the energy via closure time or closure angle can be suppressed in non-steady state operating points.

16. The arrangement of claim 10, wherein the control of the energy via closure time or closure angle can be varied only in a specific time window or angle window, the window being delimited by lower and upper gates.

17. The arrangement of claim 10, wherein the limits of the closure time or of the closure angle are characteristic field controlled, the characteristic field being dependent at least upon load or rpm and being, for example, stored in the control unit.

18. The arrangement of claim 10, wherein, to master dynamic operations, the characteristic field is subdivided into characteristic field regions and, when leaving a characteristic field region, the actual closure time value or closure angle value is stored and, upon reentry into the characteristic field region, the adapted values find application as start values of the control.

* * * * *